United States Patent [19]

Pratt

[11] Patent Number: 4,587,368

[45] Date of Patent: May 6, 1986

[54] PROCESS FOR PRODUCING LUBRICANT MATERIAL

[75] Inventor: Robert E. Pratt, Los Angeles, Calif.

[73] Assignee: Burmah-Castrol, Inc., Hackensack, N.J.

[21] Appl. No.: 565,621

[22] Filed: Dec. 27, 1983

[51] Int. Cl.[4] ..... C10L 1/16; C07C 2/02

[52] U.S. Cl. ..... 585/12; 585/10; 585/18; 585/517; 585/525

[58] Field of Search ..... 585/517, 525, 10, 12, 585/18

[56] References Cited

U.S. PATENT DOCUMENTS

| | | | |
|---|---|---|---|
| 4,045,507 | 8/1977 | Cupples et al. | 585/517 |
| 4,172,855 | 10/1979 | Shubkin et al. | 585/517 |
| 4,469,912 | 9/1984 | Blewett et al. | 585/525 |

*Primary Examiner*—Curtis R. Davis

*Attorney, Agent, or Firm*—George J. Brandt, Jr.

[57] ABSTRACT

A process is described for the production of a synthetic hydrocarbon especially useful as a base for high performance motor oils. The material is a oligomer of alpha-olefin monomer having a uniquely selective product distribution emphasizing tetramers and pentamers. This distribution is achieved through a controlled polymerization involving an initial oligomerization step followed by the delayed addition of fresh monomer to improve the yield of the desired tetramers and pentamers.

24 Claims, No Drawings

PROCESS FOR PRODUCING LUBRICANT MATERIAL

BACKGROUND OF THE INVENTION

Synthetic lubricants produced by the oligomerization of alpha-olefins are well-known. Exemplary processes for their production data as early as U.S. Pat. Nos. 2,500,161 of Seger et al. and 2,500,163 of Garwood.

The nature of the alpha-olefin from which these oligomers are produced prescribes the properties of the resultant lubricant.

With few exceptions, the state-of-the-art limits reactants for oligomerization to monomer as above described. While it has been reported that even fairly large amounts of internal and/or branched-chain olefins may be present without extremely adverse effect on the alpha-olefin oligomerization, the resultant lubricants have restricted utility and do not justify their usage as a replacement for naturally occurring petroleum fluids.

In general, linear olefins of from eight to twelve carbons in length ($C_8$ to $C_{12}$) have proven most efficacious. Normal alpha-olefins are generally preferred.

Oligomerization may likewise be accomplished with a wide variety of catalysts. Representative catalyst include such Friedel-Crafts agents as $AlCl_3$, $AlBr_3$, $BF_3$, $BCl_3$, $GaCl_4$, and the like. Although each such agent facilitates oligomerization, the activity of the catalyst will differ widely. The very active catalyst such as $AlCl_3$ will produce extremely high molecular weight polymers in conjunction with utilization of appropriate promoters. Other Friedel-Craft catalysts such as $SnCl_4$, or $GaCl_3$ may present disposal problems after use. Moveover, solid catalysts present difficulties with respect to control of the exothermic oligomerization reaction due to the heterogeneous nature of the reaction system.

A preferred catalyst has been boron trifluoride which forms a liquid complex with the necessary promoters and thus lends itself to conventional reaction systems.

Boron trifluoride and the other catalysts must be used in combination with a promoter. The promoter complexes with the $BF_3$ and in so doing provides an activated system which is required for initiation of the oligomerization reaction. Among the most widely used promoters are the alkanoic and/or inorganic acids which are suitable for selective formation of oligomers ranging from two to four monomeric units.

Conventional practice for conducting the oligomerization reaction has been to admix the promoter with the monomeric olefin in the presence of an imposed atmosphere of $BF_3$ which is normally gaseous. The presence of excess $BF_3$ necessary for the reaction is delineated by the observed pressure of $BF_3$ in the reaction vessel.

The rate of oligomerization to some degree is related to the$BF_3$ pressure since the probability of excess $BF_3$ in the liquid reactants is directly related to its pressure.

The imposed pressure of $BF_3$ can vary over a range of 1 to 4 atmospheres (14.7 psia to 65 psia).

Normally, the reaction temperature is controlled between 20° F. and 120° F. although higher temperatures may be used on occasion. Depending on the temperature and catalyst concentration, reaction times from one-half to twenty hours have been utilized.

The subsequent refining processes can be modified to yield particular product compositions. Where, for example, a lubricant consisting chiefly of higher oligomers is desired, one may remove unreacted monomer and low boiling dimer by distillation at atmospheric pressure. Trimer has also been removed in this manner, but through the less severe conditions of high vacuum distillation.

Various multi-stage oligomerization processes are also known for producing specific lubricant products. These have been limited to produce compositions having properties desirable for particular applications.

For example, U.S. Pat. No. 4,045,507 of Cupples et al. describes a continuous process in which alpha-olefin is first oligomerized in the presence of $BF_3$ butanol complex to a mixture including trimer and tetramer. That mixture is then continuously withdrawn to one or more other reactors where oligomerization is continued. According to the patent, variation among the process stages may be utilized to obtain increased yields of the trimer at the expense of higher oligomers.

U.S. Pat. No. 4,172,855 of Shubkin et al. describes the production of novel alpha-olefin oligomers by a different multi-stage means. Monomer is first dimerized with a specific catalyst selected from a group of aluminum trialkyls. The dimer is then oligomerized with a different alpha-olefin in the presence of a Friedel-Crafts catalyst such as promoted $BF_3$. The process is taught to be particularly applicable for the production of controlled copolymers of two or more alpha olefins.

After hydrogenation, the substantially saturated lubricant material is then ready for compounding. Depending upon its composition and properties, it may be employed directly in a wide variety of known applications. Alternatively, known lubricant additives may be incorporated, and/or the material may be mixed with other available lubricants, to achieve the characteristics necessary for given conventional utilities.

Products of many of these known oligomerization reactions have been primarily designed for specialized applications. Aircraft hydraulic or turbine oils, for example, possess low viscosity requirements requiring oligomerization limited to dimers, trimers and tetramers (with emphasis on the trimer). Polymers resulting from such a procedure, however, have limited application as conventional lubricants. Lubricants for higher temperature, e.g., motor oils and industrial lubricants use, require viscosities considerably higher than the aforementioned.

DESCRIPTION OF THE PREFERRED EMBODIMENTS

Many previous publications concerning oligomerization of alpha-olefins to viscous products have been concerned with the narrow requirements of aircraft hydraulic fluids. These require a mixture of oligomers primarily based on trimers (and some tetramers) of alpha-decene. This invention is directed toward minimizing trimer production to the extent that high yields of oligomers suitable especially for automotive lubricants are obtained.

As is well known, the initial reaction with conventional used promoters produces the trimer when the reaction is performed at temperatures of less than 30° C. At higher temperatures, the dimer is the predominant product. However, it has found that an unexpected distribution occurs when the rate of addition of monomer is controlled, when the promoter is specifically charcterized, and when the reaction temperature is carefully controlled. Variations in one of these conditions may not affect the product distribution markedly, but it will affect the ultimate yield adversely.

The alpha-olefin monomers utilized in the present process desirably have from eight to twelve ($C_8$ to $C_{12}$)carbons. These monomers are preferably essentially linear (or normal) in configuration to produce those properties desired for uses over a wide temperature range. Although alpha-olefin having moderately branched chains may be utilized for less demanding applications, the preferred alpha-olefin is 1-decene, which may be utilized either alone or as a predominant component of a mixed olefin feedstock.

Boron trifluoride is the catalyst of the present process. Boron trifluoride is normally gaseous and may simply be dispersed into an alpha-olefin feedstock containing an appropriate catalyst promoter. This is normally performed under sufficient pressure to ensure saturation of the feedstock. The catalyst may be reacted directly with a promoter and then combined with the monomer feedstock in the presence of excess $BF_3$.

The amounts of catalyst and promoter are not critical. In particular, the concentration of promoter may vary broadly. Desirably, however, they are present in an amount of from about 0.005 to 0.2 mole per mole of monomer and it is convenient, in the case of a gaseous component, such as $BF_3$, to saturate the feedstock to ensure provision of adequate catalyst.

In employing a volatile catalyst such as boron trifluoride, the reaction medium is desirably maintained under pressure until oligomerization has reached the desired stage. Cooling is required to control this exothermic reaction. An initial temperature below −10° C. should be avoided because of the resultant decrease in reaction rate. However, oligomerization at a temperature below 40° C. preferably between about 20° C. and 32° C., enhances the yield of the desired, higher oligomer distribution of this invention.

While many promoters are known to be effective for oligomerization catalysts using $BF_3$, it has been found that certain promoters improve the selectivity of the present process. The mechanism through which these promoters exert selectivity is not clearly understood, but it has been found that the use of at least two primary linear alcohols as promoters results in an unexpected product distribution containing minimal amounts of dimer and trimer. The preferred mixtures contain from 20 to 50 mol percent of a low molecular weight alcohol such as propanol and from 50 to 80 mol percent of a high molecular weight alcohol such as hexanol.

In accordance with a preferred embodiment of the present invention utilizing multiple promoters, the aforementioned mixture may be formed incident the delayed addition of monomer. Thus, for example, an initial monomer feedstock containing hexanol as a promoter may be employed in producing the intermediate oligomer reaction. Thereafter, an alcohol such as propanol may be introduced with the further addition of monomer. This produces a mixed promoter with the initial promoter, for the second oligomerization stage.

The selection of different promoters, mixtures and times of introduction affords an enhanced control over the ultimate distribution of product oligomers. Thus, for example, a hexanol promoter utilized in accordance with the present invention is particularly effective in reducing trimer concentration in the ultimate product. However, it may also yield increased pentamer and especially higher oligomers. Certain other promoters, such as propanol and/or phosphoric acid, are less effective in reducing trimer, but suppress higher oligomer production. Therefore, by utilizing such an additional promoter in combination with the hexanol, it is possible to further restrict and control the ultimate oligomer distribution of final product.

The optimum combination of promoters necessary to yield individually desired product will vary. In accordance with the above teachings, however, their selection and use become a matter of simple experimentation within the skill of routineers in this art.

As previously stated, the present oligomerization reaction is carried out sequentially to allow for a delayed addition of alpha-olefin monomer. Thus during oligomerization, a further quantity of monomer may be added to the partial reaction product containing intermediate oligomer. By proceeding in this manner, the desired distribution of product oligomers may be obtained as the further monomer preferentially increases the existing degree of oligomerization.

This objective may ensured by allowing the initial feedstock to react to the desired degree, usually less than 5% and desirably less then 3%, of alpha-olefin monomers by weight of the intermediate oligomer. The further addition of alpha-olefin may then be added slowly, desirably at a rate sufficient to maintain this concentration until the oligomerization reaction reaches completion.

It is ordinarily preferred that the further addition (or delayed addition) of monomer comprise from 10 to 60%, preferably from 30 to 45%, by weight of the previously formed intermediate oligomer (or original weight of monomer). This monomer may be added continuously to the reaction medium, for example over a period of at least an hour, to accentuate the production of the desired molecular weight product.

The oligomerization reaction may be allowed to continue essentially to completion after the delayed addition has ceased. This state is conveniently marked by a residue of less than about 2% of monomer by weight of oligomer. Upon completion, the product may be quenched by neutralization.

In accordance with the present sequential process, the partial reaction product of the first stage is characterized by a trimer content in excess of 15%, and more commonly in excess of 20% or even 25%, by total oligomer weight. Conversely, its tetramer content is generally below about 30%.

Pursuant to the second stage or delayed addition of monomer, the foregoing trimer content is ordinarily reduced by at least 5% preferably over 10%, of total oligomer weight. This yields a decreased trimer concentration which is less than about 15% desirably less 10%, by total oligomer weight.

That trimer decreases is largely reflected in a corresponding increase in the tetramer and pentamer concentration of the oligomer product. This ultimate product ordinarily contains at least about 30%, preferably from about 30% to 50%, of tetramer by total weight. Moreover, the combined content of tetramer and pentamer may be at least about 45%, preferably from about 50% to 85% by weight of total oligomer produced.

The shift in oligomer distribution resultant from delayed addition of monomer is also dramatically evident from the change in ratio of trimer-to-tetramer during this process. The first stage, intermediate oligomer has a weight ratio of over 0.5, most commonly between about 0.5 and 1. The product oligomer, however, should ordinarily have a ratio of less than 0.4, desirably less than 0.3.

After the second stage reaction has ceased, the high oligomer product is desirably separated. This separation may be performed as previously described. Thus, for example, catalyst and promoter may conveniently be removed by washing with aqueous caustic.

Monomer and dimer, which constitutes less than 5%, typically less than about 3%, of product oligomer may be separated by a simple atmospheric distillation. Unlike many prior art processes, it is generally unnecessary to subject the oligomer product to an expensive purification such as vacuum distillation. The present invention works to effect a dramatic shift in the normal products distribution to higher oligomer such as tetramer and pentamer. Consequently, the amount of trimer in the present products may be controlled through this process to achieve acceptable limits and need not be further reduced.

The separated oligomer product may be hydrogenated by conventional means. Thus, it can be placed in a vessel with a standard catalyst and pressurized under well-known hydrogenation conditions.

Hydrogenation is desirably continued until the oligomer product is substantially saturated. The degree of unsaturation remaining is conveniently monitored by bromine number. The lubricant should have a bromine number of less than 10, preferably less than 2.0. This ensures the stability of the product lubricant.

The following examples illustrate the manner in which the present process may carried out and also allows comparison with results achieved by conventional processes outside the scope of this invention. Unless otherwise specified, all parts are on a weight basis.

EXAMPLE I

A catalyst composition is formed by bubbling gaseous boron trifluoride through an equimolar mixture of 1-hexanol and 1-propanol. The composition is then added to 1100 g of n-decene which is then saturated with boron trifluoride gas, to produce a feedstock containing 0.02 mols of catalyst per 100 g of alpha-olefin.

800 g of the feedstock is placed in a reaction vessel at 10° to 30° C.

Under vigorous stirring and constant cooling, the exothermic oligomerization is allowed to continue at a temperature below 25° C. After about one and one-half hours, the initial monomer is substantially reacted (about 10% monomer remains admixed with the resultant intermediate oligomer).

At this time, addition of the remaining 300 g of feedstock to the vessel is commenced and the reaction is allowed to resume. The addition is made continuously over a period of approximately two hours until all the origial feedstock has been utilized. This slowly reduces the concentration of monomer until the reaction reaches completion.

The reaction product is washed with aqueous alkali and the organic material is stripped under atmospheric conditions to eliminate monomer and dimer. The remaining oligomer product is then hydrogenated to produce a stable lubricant material. The product can be used for this purpose, e.g., as a motor oil as such or otherwise be used for the manufacture of automobile and gear lubricants, e.g., being blended with natural and/or synthetic components in known manner to provide a motor oil.

To ascertain the affects of the delayed addition of monomer, samples of the intermediate and final oligomer product (both, prior to purification ) are analyzed by gas chromatography. The results are as follows:

| OLIGOMER CARBON NUMBER | CONCENTRATION INTERMEDIATE OLIGOMER (%) | CONCENTRATION OF OLIGOMER PRODUCT (%) |
|---|---|---|
| $C_{10}$ | 2.88 | 0.92 |
| $C_{20}$ | 1.64 | 0.84 |
| $C_{30}$ | 26.93 | 6.60 |
| $C_{40}$ | 28.48 | 42.14 |
| $C_{50}$ | 24.31 | 34.79 |
| $C_{60}$ | 11.38 | 11.04 |
| $C_{70}$ | 4.10 | 3.52 |

This comparison reflects the dramatic shift in product distribution attendant the present invention. Unlike the one step product typical of prior art processes, the oligomer product of two-step or delayed monomer addition emphasizes higher oligomers. The product of the present invention is composed predominantly of tetramer ($C_{40}$) and pentamer ($C_{50}$). Even more significantly, it shows over a twenty percent reduction, from 26.93% to 6.60&, of less desirable trimer ($C_{30}$).

EXAMPLE II

The procedure of Example I was followed except a 75%/25% molar mixture of 1-hexanol and 1-propanol was employed. Samples of the intermediate and final oligomer product provided the following results:

| OLIGOMER CARBON NUMBER | CONCENTATION INTERMEDIATE OLIGOMER (%) | CONCENTRATION OF OLIGOMER PRODUCTS (%) |
|---|---|---|
| $C_{10}$ | 6.0 | 1.0 |
| $C_{20}$ | 1.0 | .8 |
| $C_{30}$ | 22.5 | 6.9 |
| $C_{40}$ | 28.0 | 38.0 |
| $C_{50}$ | 25.5 | 38.5 |
| $C_{60}$ | 12.0 | 12.5 |

The foregoing reflects the predominance of tetramer ($C_{40}$) and pentamer ($C_{50}$) and reduced trimer ($C_{30}$) of the products of the invention.

EXAMPLE III

The product for Example II was hydrogenated using Ni on kieselguhr after removal of unreacted monomer and dimer. The hydrogenated product has a viscosity of approximately 8 cS at 100° C. The product was compounded with appropriate inhibitors, dispersants, and antiwear additives to produce a high quality motor oil satisfying severe test engine requirements.

Although the present invention has been described with respect to preferred embodiments, it is understood that any modifications and variations may be utilized without departing from the spirit or scope of the invention. Such modifications and variations remain within the purview of the appended claims.

What is claimed is:

1. A process for producing a synthetic lubricant material comprising oligomerizing $C_8$–$C_{12}$ alpha-olefin monomer in the presence of an alcohol promoted boron trifluoride catalyst until said monomer has substantially reacted to produce an intermediate oligomer, controlledly adding over a predetermined period a further aliquot of monomer to said intermediate oligomer and while continuing the oligomerization essentially to completion thereby to obtain a higher oligomer product.

2. The process of claim 1, wherein the trimer/tetramer ratio of the intermediate oligomer is at least 0.5 and the trimer/tetramer ratio of the oligomer product is less than 0.4.

3. The process of claim 2, wherein the alpha-olefin monomer comprises n-decene.

4. The process of claim 1, wherein the aliquot of monomer comprises from 10 to 60% by weight of the intermediate oligomer.

5. The process of claim 5 wherein the oligomerization is performed at temperature below 40° C.

6. The process of claim 5, wherein the catalyst promoter is a primary linear alcohol and the alpha-olefin comprises n-decene.

7. The process of claim 6, wherein the oligomer product is hydrogenated to form a substantially saturated lubricant material.

8. The process of claim 7, wherein monomer and dimer are separated from the oligomer product prior to hydrogenation.

9. The process of claim 8, wherein the aliquot of alpha-olefin monomer is added slowly to the intermediate oligomer over a period of at least one hour while the oligomerization is continued.

10. The process of claim 9, wherein during said period the aliquot is added, the monomer is maintained at a concentration of less than 5% by weight of oligomer.

11. The process of claim 10, wherein the intermediate oligomer comprises in excess of 20% trimer and less than about 30% tetramer by weight.

12. The process of claim 11, wherein the oligomer product comprises less than 15% trimer and from about 30 to 50% tetramer by weight.

13. The process of claim 12, wherein the oligomer product has a combined tetramer and pentamer content of at least about 45% by weight.

14. The process of claim 1, wherein the further aliquot of monomer contains alcohol promoted boron trifluoride catalyst.

15. The process of claim 15, wherein the alcohol promoter of the further aliquot is different from that of the initial catalyst promoter.

16. The process of claim 1, wherein the promoter is a mixture of at least two primary linear alcohols.

17. The process of claim 16, wherein one of said alcohols is employed to reduce trimer concentration during oligomerization and another of said alcohols is employed to suppress concentration of oligomers higher then tetramer during oligomerization.

18. The process of claim 17, wherein the promoter is a mixture of 1-hexanol and 1-propanol, the 1-hexanol being present in the mixture in the range about 50 mol percent to about 80 mol percent.

19. The process of claim 18, wherein the 1-hexanol is present in the amount about 50 mol percent.

20. The process of claim 18, wherein the 1-hexanol is present in the amount about 75 mol percent.

21. A synthetic lubricant product produced by oligomerization of a $C_8$–$C_{12}$ alpha-olefin monomer comprising a substantially saturated oligomer mixture of;

(a) less than 15% trimer, (b) 30 to 50% tetramer, and (c) 50 to 85% of combined and tetramer and pentamer.

22. The product of claim 21, wherein the trimer to tetramer ratio is less than about 0.3.

23. The product of claim 24, wherein the mixture contains less than 3% of combined monomer and dimer.

24. The product of claim 21, wherein it is admixed with a natural lubricating oil.

* * * * *